United States Patent [19]

Kitawaga

[11] 4,154,133

[45] May 15, 1979

[54] ENVELOPE WAVEFORM GENERATING APPARATUS

[75] Inventor: Hiroshi Kitawaga, Hamamatsu, Japan

[73] Assignee: Kabushiki Kaisha Kawai Gakki Seisakusho, Hamamatsu, Japan

[21] Appl. No.: 810,928

[22] Filed: Jun. 29, 1977

[30] Foreign Application Priority Data

Jul. 2, 1976 [JP] Japan ..... 51-78650

[51] Int. Cl.[2] ..... G10H 1/02

[52] U.S. Cl. ..... 84/1.26; 84/1.27; 84/1.24; 84/DIG. 7

[58] Field of Search ..... 84/1.01, 1.03, 1.09, 84/1.26, 1.27, DIG. 7, 1.13, 1.24

[56] References Cited

U.S. PATENT DOCUMENTS

| | | | |
|---|---|---|---|
| 3,882,751 | 5/1975 | Tomisawa | 84/1.01 |
| 3,981,217 | 9/1976 | Oya | 84/1.01 |
| 4,041,825 | 8/1977 | Pascetta | 84/1.01 |
| 4,067,253 | 1/1978 | Wheelwright | 84/1.27 |

*Primary Examiner*—J. V. Truhe
*Assistant Examiner*—William L. Feeney

[57] ABSTRACT

An envelope waveform generating apparatus comprising a key code generating device composed of a means for releasing key code data and a means for outputting first and second control signals, a key assignor composed of a means for outputting a third control signal, a level setting means, and a function generator. The envelope waveform generating circuit is provided with a touch response so that the level of envelope waveform may readily be set.

5 Claims, 24 Drawing Figures

FIG. 8A $\phi_0$
FIG. 8B $\phi_1$
FIG. 8C $\phi_2$
FIG. 8D $\phi_3$
FIG. 8E $CP_1$
FIG. 8F $CP_2$
FIG. 8G OC
FIG. 8H CS (KDC)
FIG. 8I BS
FIG. 8J MS
1 2 3 4 5 6 7 8
1 2 3 4 5 6 7 8
BREAK OPENING
MAKE CLOSING

ENVELOPE WAVEFORM GENERATING APPARATUS

BACKGROUND OF THE INVENTION

1. Field of the Invention

The present invention relates to an envelope waveform generator circuit to which a touch response is added.

2. Description of the Prior Art

In the prior art electronic musical instruments, systems for controlling turn-on and turn-off envelope waveforms of musical note signals generally used include a system for applying a charge and discharge voltage of a time constant circuit composed of capacitors and resistors to a gate circuit to thereby to control the gate circuit by opening and closing thereof.

In the system as described above, however, it has been impossible to provide a suitable envelope control having a touch response and difficult to provide integration.

In alternative systems, there is proposed a system for directly reading out an envelope waveform memory subjected to digital sampling. This system, however, poses disadvantages such that quantitized noises are increased and in order to eliminate thereof, a memory capacity must be increased, which requires more elements in number, and particularly in case where the touch response is desired to be added, a number of circuits are required and on the other hand, controlling becomes extremely complicated.

SUMMARY OF THE INVENTION

It is therefore an object of the present invention to eliminate those disadvantages noted above by providing an envelope waveform generator circuit with less quantitized noises which is simple in construction, which is provided with a touch response, and which can readily obtain a suitable envelope waveform by setting a level by means of the touch response.

The above-mentioned object may be achieved by the present invention which provides an envelope waveform generating apparatus comprising: a key code generating device which comprises a means for dividing a plurality of key switches having two contacts of make and break into blocks to successively scan them with a predetermined clock, comparing a switch information under the scanning every block with a switch information at the time prior to scanning to detect changes in opening and closing of the break and in opening and closing of the make, and successively and continuously producing key code data corresponding to the switches with a predetermined priority order and a predetermined clock in response to the change thereof, and a means for outputting a first control signal representative of key code data by means of the opening of the break and a second control signal representative of key code data by means of the closing of the make; a key assignor which comprises a means for successively reading-in the key code data into empty channels in predetermined order of priority and a means for comparing a stored key code with the key code data produced from said key code generating device and upon coincidence therebetween, a third control signal being produced; a means for functionally count time from the opening of the break to the closing of the make by means of said third control signal to calculate the highest level of the envelope waveform for setting the level; and a function generator having a step responsive characteristic relative to various set values of levels and capable of producing a suitable envelope waveform.

BRIEF DESCRIPTION OF THE DRAWINGS

In describing the present invention, reference will be made to the accompanying drawings in which.

DESCRIPTION OF THE PREFERRED EMBODIMENT

Figure 1:
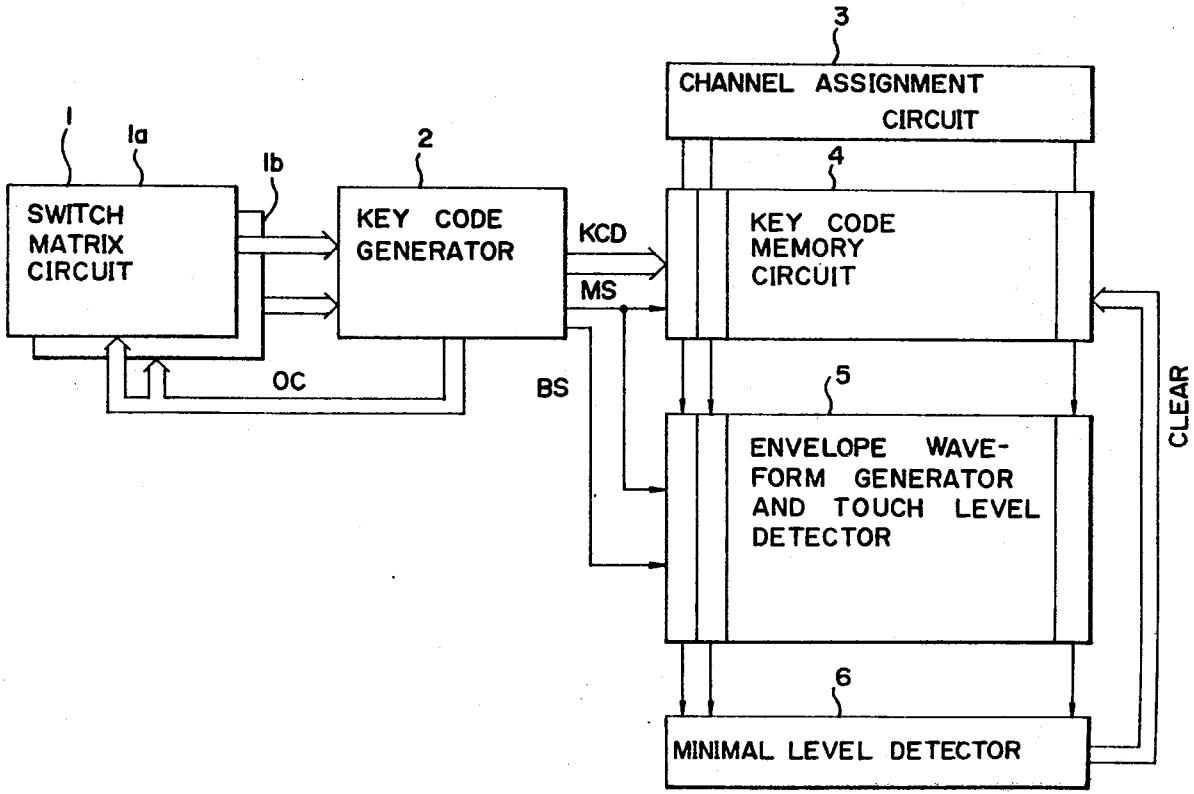
FIG. 1 is a block diagram showing the structure of an embodiment according to the present invention.

FIG. 1 is an explanatory view showing the structure of an embodiment of an envelope waveform generator circuit in accordance with the present invention. A switch matrix circuit 1 has a break contact 1*a* and a make contact 1*b*, and pass lines OC are successively scanned to input make data MD and break data BD into a key code generator circuit 2. The key code generator circuit 2 outputs key code data KCD, signal BS indicative of the opening of the break contact, and signal MS indicative of the closing of the make contact. A key code memory circuit 4 has 10 channels, and an empty channel is detected by a channel assignment circuit 3 to successively write-in key code data KCD, which is outputted from the key code generator circuit 2, into the empty channel in accordance with the predetermined priority order, and compare the stored key code with a key code successively fed to output a coincidence signal ES. An envelope waveform generator and touch level detector circuit 5 starts the counting operation of touch level detection by the signal BS and stops the counting operation by the signal MS to temporarily store it and determining a maximum level of the envelope waveform. Simultaneously, attacking is started by the signal MS. At the maximum level of attack, decay (down) is started, and when the key is released, the release is started by the coincidence signal ES and level "0" is reached, the channel is reset. A minimal level detector circuit 6 is provided to detect a channel wherein the envelope waveform is extremely decayed and clearing such channel to write-in a successively coming key code data.

Figure 2:
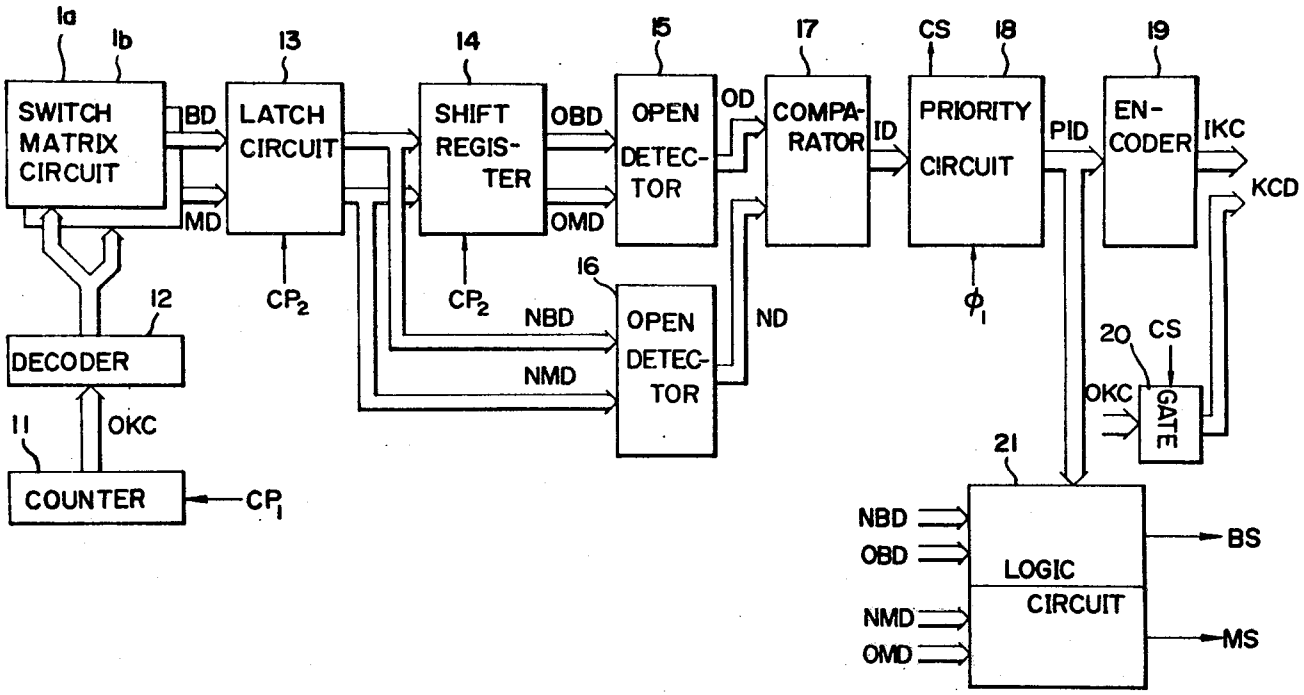
FIGS. 2–7, 9–11, and 13–15 are detailed illustrations showing principal parts in the embodiment shown in FIG. 1.

FIG. 2 is an explanatory view of the key code generator circuit 2 shown in FIG. 1. The switch matrix circuit 1 has 144 make and break contact switches which constitute 12 blocks each having 12 make and break contact switches, and a duodecimal counter 11 is counted by a clock $CP_1$ to output a block code OKC, which is entered into a decoder 12 to successively scan block pass lines in the switch matrix circuit 1. Break data BD and make data MD of switch data outputted from the pass lines of the break contact 1a and make contact 1b are temporarily stored by a clock $CP_2$ in the latch circuit 13. New data NBD and NMD of said output are entered into a 24-bit 12-stage shift register 14 and are shifted by the clock $CP_2$ to output old data OBD and OMD prior to scanning. These data OBD, OMD and NBD, NMD detect the state of change in make and break by means of open detector circuits 15, 16 which comprise two input NOR gates, old data OD and new data ND being entered into a comparator 17. The comparator 17 compares the function of key switch at two times to detect changes in make - open - break and outputting a detection signal ID. This output is entered into a priority circuit 18 and is successively selected by a clock $\phi_1$ in accordance with the predetermined priority order to output a signal PID. It will be noted that signal CS of the signal PID is outputted and clocks $CP_1$ and $CP_2$ are inhibited to stop block scanning. The signal PID enters into an encoder 19 and then formed into a binary code and key code IKC in the block is outputted. On the other hand, the block code OKC is gated by the signal CS in a gate circuit 20 and is outputted as the key code data KCD in parallel with the key code IKC. Further, signals NBD and OBD indicative of the key code data by opening of the break and signals NMD and OMD indicative of the key code data by closing of the make are entered into a logic circuit 21, and outputting signals BS and MS.

Figure 3:
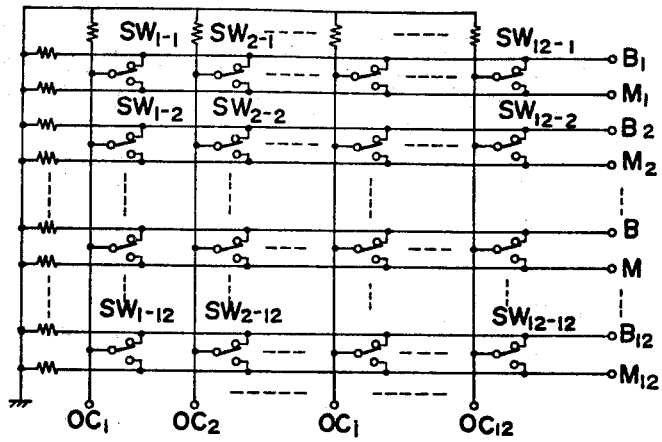

FIG. 3 is a detailed explanatory view of the switch matrix circuit 1 shown in FIG. 2. 144 key switches Sw1-1- Sw 12-12 are arranged at intersections between pass lines $OC_1$-$OC_{12}$ and $B_1$, $M_1$, $B_2$, $M_2$, . . . . $B_{12}$, and $M_{12}$, respectively, as shown, 12 key switches arranged in pass lines $OC_1$-$OC_{12}$ constituting one block.

Figure 4:
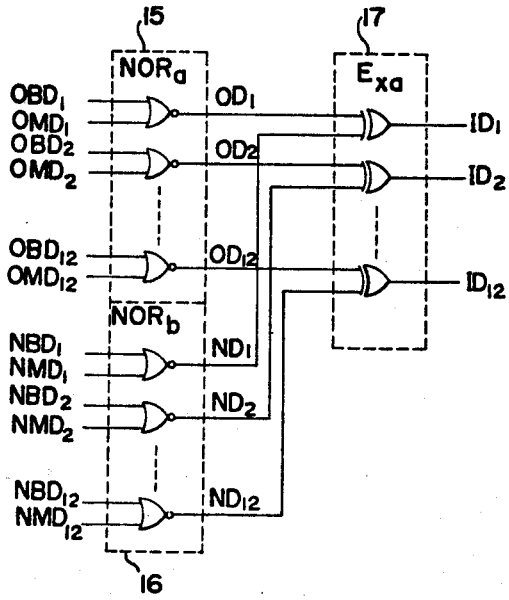

FIG. 4 is a detailed explanatory view of the open detector circuits 15, 16 and the comparator circuit 17 shown in FIG. 2. Break data $OBD_1$ and make data $OMD_1$ prior to scanning are inputted into a NOR circuit NORa, and break data $NBD_1$ and make data $NMD_1$ are inputted into a NOR circuit NORb, to detect the opening and output the signal $OD_1$ and $ND_1$. Both the signals are inputted into an exclusive OR circuit EXa to detect a change in two times and outputting a detection signal $ID_1$. Similarly to the above manner, break data $OBD_2$-$OBD_{12}$ and make data $OMD_2$-$OMD_{12}$ prior to scanning are inputted into the NOR circuit NORa to output signals $OD_2$-$OD_{12}$, break data $NBD_2$-$NBD_{12}$ and make data $NMD_2$-$NMD_{12}$ during the scanning are inputted into the NOR circuit NORb to output signals $ND_2$-$ND_{12}$, and these signals $OD_2$-$OD_{12}$ and $ND_2$-$ND_{12}$ are inputted into the exclusive OR circuit 17 to output signals $ID_2$-$ID_{12}$.

Figure 5:
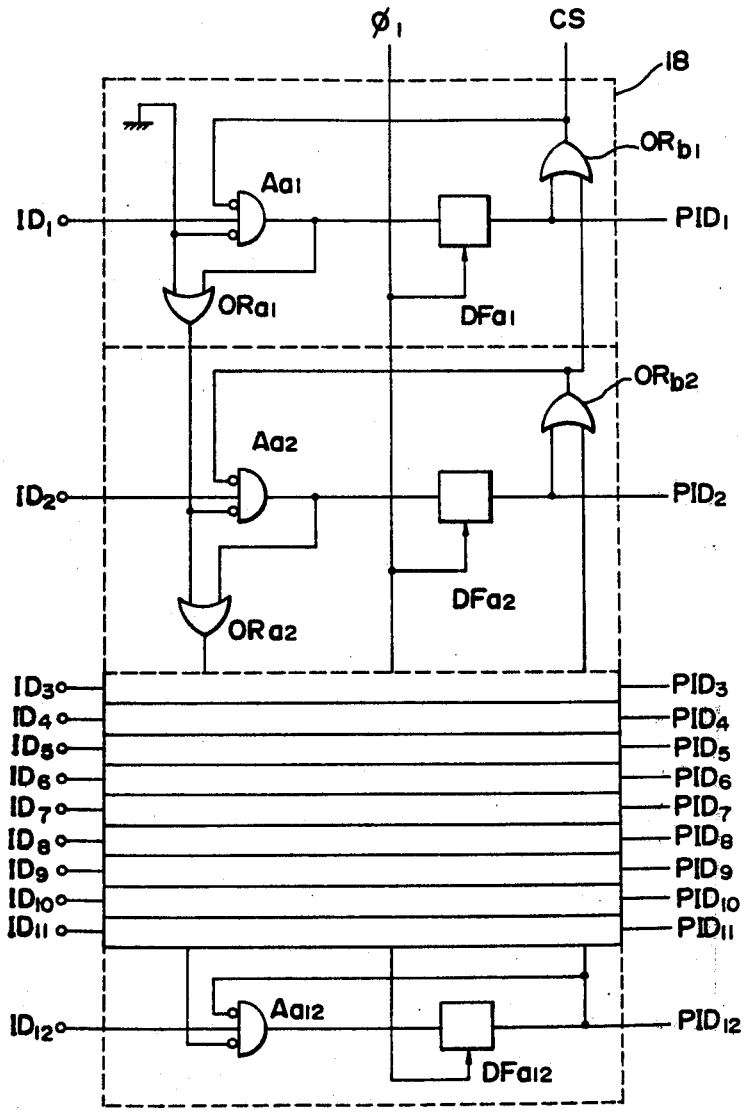

FIG. 5 is a detailed explanatory view of the priority circuit 18 shown in FIG. 2. Assume that signals $ID_2$, $ID_{12}$ are 37 1," the OR circuits ORa1 and ORb2 output "0," is applied to an AND circuit Aa2, which outputs "1." Thus, the OR circuit ORa2 outputs "1" and thereafter, $OR_{11}$ outputs "1" inverted-input "0" is applied to AND circuit Aa12, which inhibits a signal $ID_{12}$, whereby only the signal $ID_2$ is inputted from the AND circuit Aa2 into a D-type flip-flop DFa2. The D-type flip-flop DFa2 is latched by the clock $\phi_1$, the flip-flop DFa2 outputting signal $PID_2$. This output "1 " is inputted into OR circuit ORb2, and inverted-input "0" is inputted AND circuit Aa2 to inhibit signal $ID_2$. This causes the OR circuit ORa2 to be "0," and in AND circuit Aa12, signal $ID_{12}$ is inputted into the D-type flip-flop DFa12 and outputting signal $PID_{12}$ with the successive clock $\phi_1$. During the outputting of the signal $PID_{12}$, an OR circuit ORb1 outputs a signal CS of "1." In this manner, a plurality of input signals ID are successively selected and outputted by the clock $\phi_1$ and inputtted into an encoder 19 to be formed into a binary code.

Figure 6:
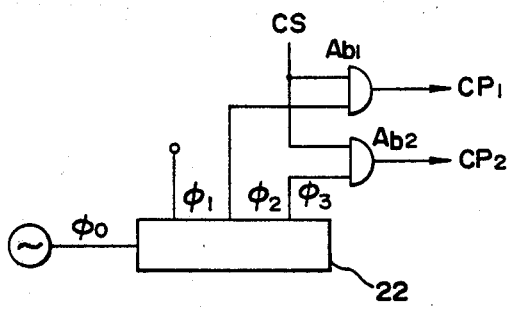

FIG. 6 illustrates a control block of the abovementioned key code generator circuit 2. A master clock $\phi_o$ is inputted into a ternary ring counter 22 to output 3-phase clocks $\phi_1\phi_2$, and $\phi_3$. This provides timing of data, and the clocks $\phi_2$, $\phi_3$ are inputted AND circuits Ab1 and Ab2 to output clocks $CP_1$ and $CP_2$ inhibited by the signal CS to thereby effect block scanning.

Figure 7:
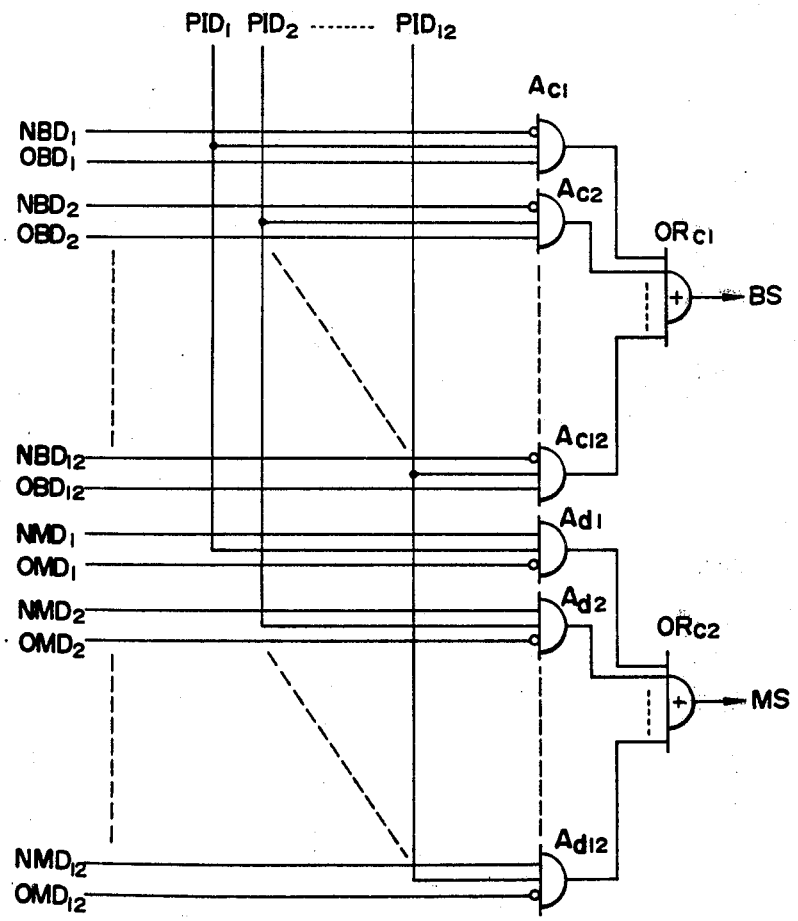

FIG. 7 is a detailed explanatory view of the logic circuit 21 shown in FIG. 2. Break signals $\overline{NBD}_1$-$\overline{NBD}_{12}$, $OBD_1$-$OBD_{12}$ and signals $PID_1$-$PID_{12}$ are inputted into AND circuit Ac1-Ac12 with the same characters combined, and when the signal NBD is "0," the signal OBD is "1" and the signal PID is "1," then the AND circuit Ac outputs "1" so that a signal BS indicative of the opening of the break is outputted from the OR circuit $OR_{cl}$ which provides a logical sum of outputs of the AND circuits Ac1-Ac12. Also make signals $NMD_1$-$NMD_{12}$, $\overline{OMD}_1$-$\overline{OMD}_{12}$ and signals $PID_1$-$PID_{12}$ of two times are similarly inputted into AND circuits Ad1-Ad12, and signal MS indicative of the closing of the make is outputted from an OR circuit $OR_{c2}$ which provides a logical sum of outputs of the AND circuits Ad1-Ad12.

Figure 8:
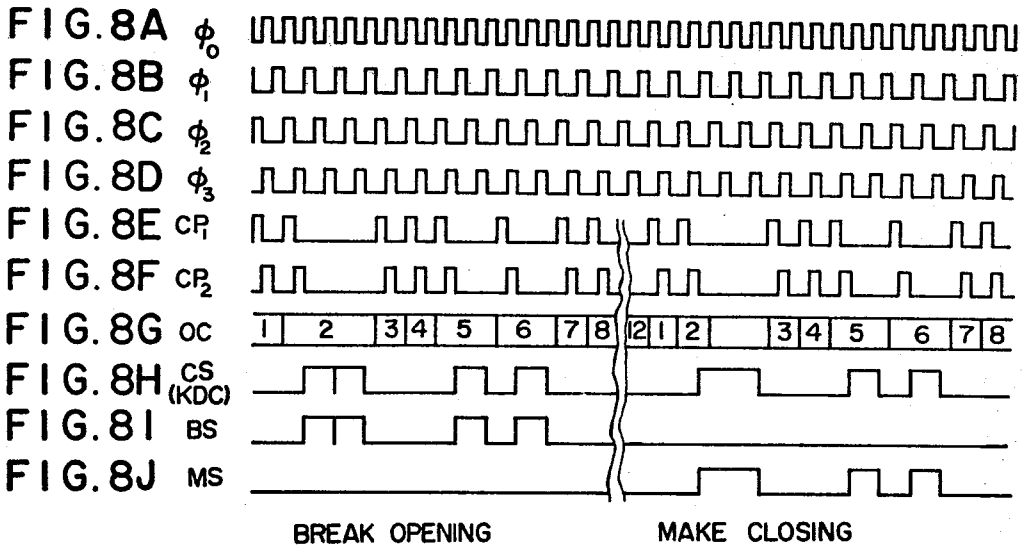
FIG. 8 A to J are a timing chart for explaining the operation of a key code generator circuit.

FIG. 8 A to J shows a timing chart for various signals in the key code generator circuit shown in FIG. 2. In FIG. 8A, the character $\phi_0$ designates a master clock, and in FIGS. 8 B to D, clocks $\phi_1$, $\phi_2$, and $\phi_3$ are 3-phase clocks as shown in FIG. 6 and are used to provide timing required for synchronization between blocks and data delay. In the case where four switches are depressed and disengaged, the opening of break and the closing of make are shown on the left and right, respectively, in FIG. 8 E to J. For example, let $SW_{m\text{-}n}$ be the *n* switch of the *m* block, various signal waveforms of FIG. 2 in case of the opening of break and the closing of make of four switches $SW_{2\text{-}2}$, $SW_{2\text{-}12}$, $SW_{5\text{-}7}$ and $SW_{6\text{-}3}$ are shown. When the change in state of switches in the blocks is detected by the aforesaid comparator 17 with a clock $CP_1$ of a counter in FIG. 8 E and a clock $CP_2$ of a latch circuit in FIG. 8 F placed in correspondence with the block scanning of pass line OC in FIG. 8G, the clock between the blocks is stopped. The switch state change signal ID outputted from the comparator 17 is fed into the priority circuit 18 to output a signal PID in accordance with the priority order, but during the outputting of the signal PID, the signal CS in FIG. 8H is released to stop the $CP_1$ and $CP_2$. The signal PID outputted from the priority circuit 18 is entered into a logic circuit 21, and a signal for opening break shown in FIG. 8I and a signal for closing make shown in FIG. 8J are separately extracted in correspondence with the signal CS shown in FIG. 8H, as discussed in FIG. 7. It will be noted that the signal PID is formed into a binary code as the key code IKC in the block by means of an encoder 19 and then outputted in parallel together with the block code OKC of output of the counter 11 gated by the signal CS to obtain the key code data KCD, as previously mentioned.

Figure 9:
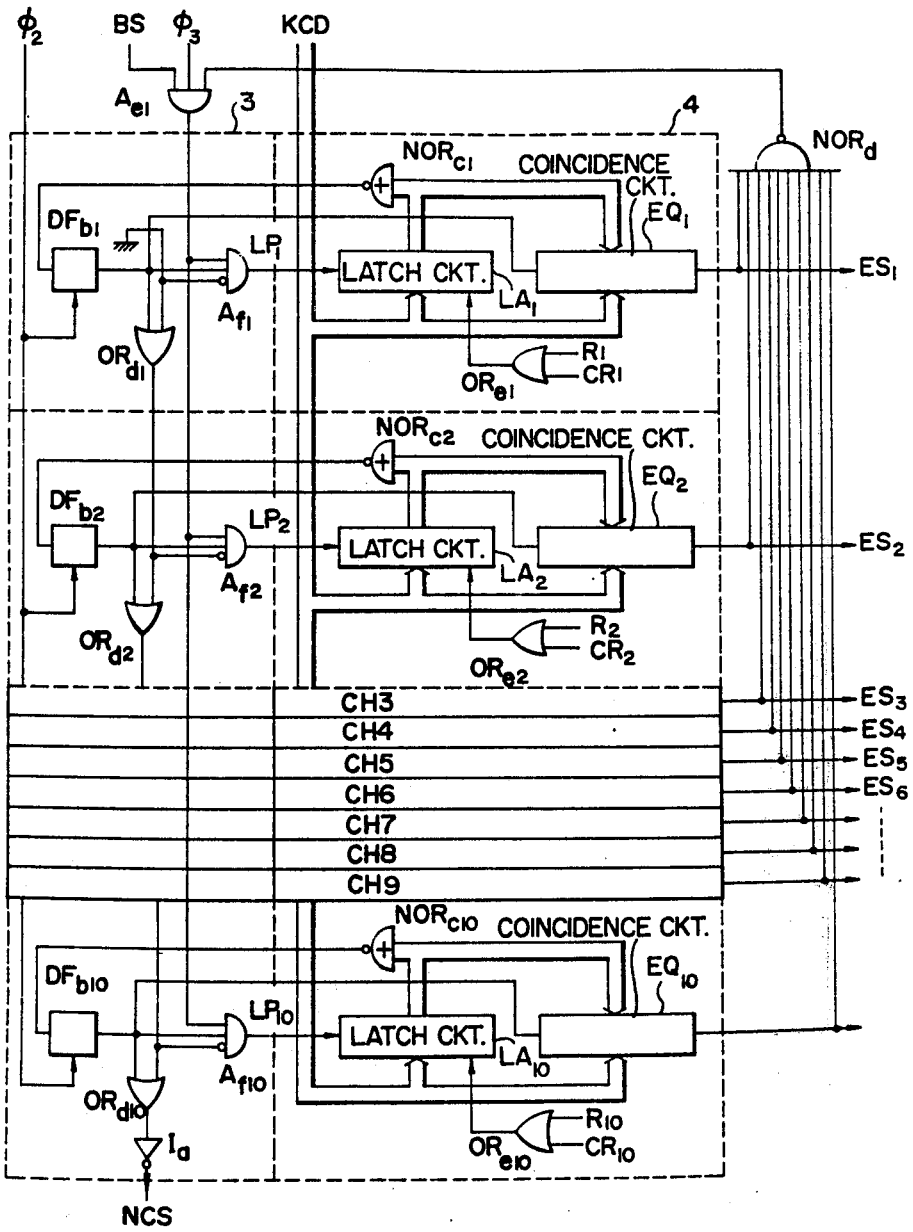

FIG. 9 is a detailed explanatory view of the key code memory circuit 4 and the channel assignment circuit 3 shown in FIG. 1. Key code data KCD outputted from the key code generator circuit 2 are parallelly inputted into latch circuits $LA_1$-$LA_{10}$ and coincidence circuits $EQ_1$-$EQ_{10}$ within the memory circuit 4. In case of empty channel, NOR circuit $NOR_c$ outputs "1," and the empty channel is detected by the clock $\phi_2$ in the D-type flip-flop $DF_b$. Outputs of D-type flip-flops $DF_{b1}$-$DF_{b10}$ are inputted into AND circuits $A_{f1}$-$A_{f10}$ and OR circuits $OR_{d1}$-$OR_{d10}$, and a latch pulse LP is applied to a latch circuit LA whose priority is highest among empty channels. Assume that all of channels are empty channels, all of the D-type flip-flops $DF_{b1}$-$DF_{b10}$ output "1," which is inputted into the AND circuits $A_{f1}$–$A_{f10}$. On the other hand, output of the D-type flip-flop $DF_{b1}$ is inputted into the OR circuit $OR_{d1}$, and inverted-input "0" is inputted into the AND circuits $A_{f1}$–$A_{f10}$ by the similar OR circuit $OR_d$ to inhibit the latch pulse LP, which is outputted only from the AND circuit $A_{f1}$. The clock $\phi_3$ is outputted only when there present a signal ES and there present no coincidence output by the AND circuit $A_6$. Assume that the outputted key code data KCD should be remained written in either key code memory, it would be operated so that the coincidence signal ES should be outputted from said channel so as not to write-in the same key code through the NOR circuit $NOR_d$. Further, in a state where no empty channel is present, "0" is outputted from the OR circuit $OR_{d10}$ and is inverted by an inverter Ia to output a signal NCS of "1." Said signals LP and ES are applied to the envelope waveform generator circuit and touch level detector circuit 5, and the signal NCS is applied to the minimum level detector circuit 6. It will be noted that the latch circuit LA is reset by application of reset signals R and CR through the OR circuit $OR_e$.

Figure 10:
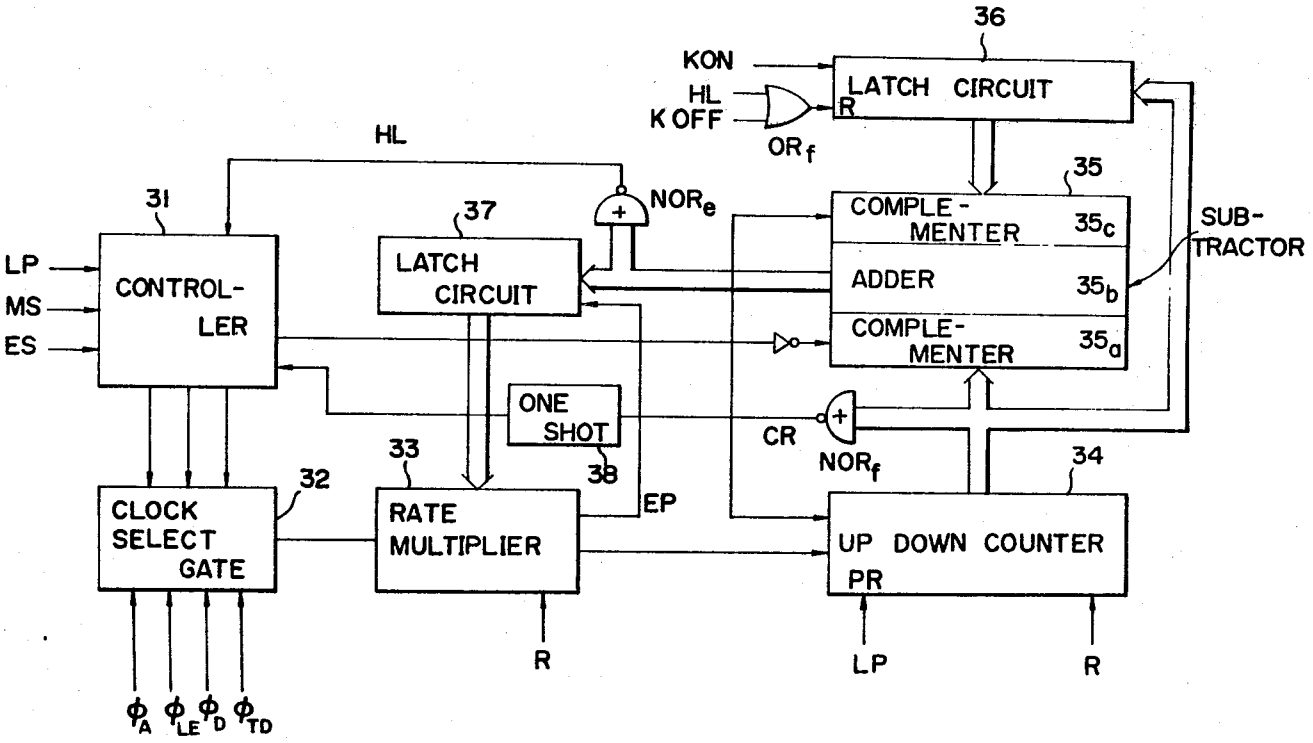

FIG. 10 is a detailed explanatory view of the envelope waveform generator circuit and touch level detector circuit 5.

In FIG. 10, attack (start) clock $\phi_A$, decay (down) clock $\phi_D$, release clock $\phi_{LE}$, and touch level detection clock $\phi_{TD}$ are selected and released at a clock select gate 32 by means of output of a control circuit 31 and input a rate multiplier or a pulse density multiplier 33. Pulse density function outputted therefrom is counted by a 8-bit up-down counter 34 and outputted as the envelope waveform and touch level. A latch circuit 36 is provided to determine a target value of the up-down counter 34, and the difference in value between the latch circuit 36 and the up-down counter 34 is outputted in the form of a 7-bit, which is the value ½ of said difference, by a subtractor 35 comprising complementers 35*a*, 35*c* and an adder 35*b*, and the value thereof is latched in a latch circuit by the signal EP which outputs one pulse every 128 pulses from a rate multiplier 33. This value determines the pulse density of the rate multiplier 33 and decays to the pulse density of ½ every 128 pulses. That is, the value of the up-down counter 34 is outputted in the form of a linear approximate waveform of a sum of geometrical progression of ½ with the target value of the latch circuit 36 being the gradually access line. NOR circuit $NOR_e$ outputs a signal HL when the envelope waveform is in coincidence with the target value, and NOR circuit $NOR_f$ outputs a signal CR through a one shot multivibrator 38 when the envelope waveform is terminated to reset said channel.

Figure 11:
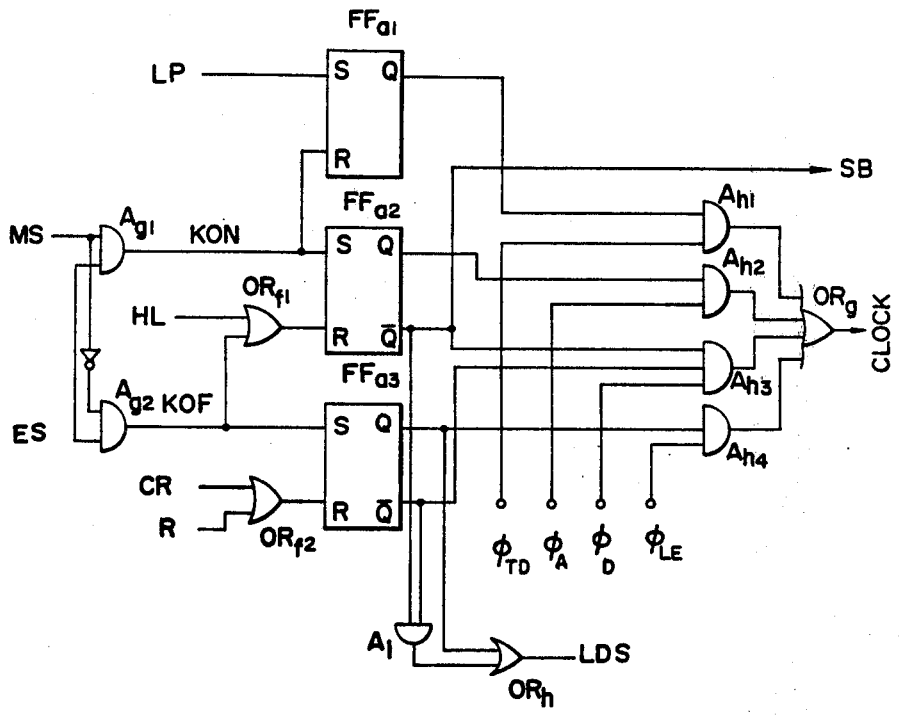

FIG. 11 is a detailed explanatory view of the control circuit 31 and the clock select gate 32 shown in FIG. 10. Flip-flop $FF_{a1}$ is set by the latch pulse LP outputted when the key is depressed to open the break contact, and a touch detection clock $\phi_{TD}$ is outputted through AND gate $A_{h1}$ and OR circuit $OR_g$. Flip-flop $FF_{a1}$ is reset through AND circuit $A_{g1}$ by signals MS and ES outputted when the make contact is closed to thereby set flip-flop $FF_{a2}$, and an attack clock $\phi_A$ is outputted through OR circuit $OR_g$ from AND circuit $A_{h2}$. When attack is terminated and the envelope waveform reaches the target value, the signal HL is outputted and flip-flop $FF_{a2}$ is reset through OR circuit $OR_{f1}$ so that a decay clock $\phi_D$ is outputted through AND circuit $A_{h3}$ and OR circuit $OR_g$. When the key is outputted, the coincidence signal ES causes flip-flop $FF_{a2}$ to be reset through AND circuit $A_{g2}$ and OR circuit $OR_{f1}$ and setting flip-flop $FF_{a3}$ to output a relay clock $\phi_{LE}$ from AND circuit $A_{h4}$. When the envelope is terminated, a channel reset signal CR is outputted to reset flip-flop $FF_{a3}$ and inhibit all clocks. In this manner, the clocks $\phi_A$, $\phi_D$, $\phi_{LE}$, $\phi_{TD}$ are selected. It will be noted that a signal SB for controlling the up-down of the counter 34 and the subtracting direction of an adder-subtractor 35 is extracted from output $\overline{Q}$ of the flip-flop $FF_{a2}$.

Assume that the key is depressed, the break contact is opened and as a consequence, the signal LP is outputted and a touch detection clock $\phi_{TD}$ is outputted from the clock select gate 32. On the other hand, the up-down counter 34 is preset to the highest level to start down-counting. Then, the target value 0 level is applied to the latch circuit 36 and the subtractor outputs ½ of the difference thereof. This value is latched at the latch circuit 37 every 128 pulses of the clock $\phi_{TD}$ to control the output pulse density of the rate multiplier 33, and the up-down counter 34 outputs the value corresponding to a curve A in FIG. 12 described later. Next, the make contact is closed to thereby output the signal MS and signal ES, and the value of the up-down counter 34 at that time is latched at the latch circuit 36 to assume the highest level of the envelope waveform. Thereafter, the up-down select gate 34 is reset, and the attack clock $\phi_A$ is delivered from the clock select gate 32. The clock density delivered from the rate multiplier 33 is successively controlled by the value ½ of the difference between the target value and the count value every 128 pulses. When the clock $\phi_A$ is attacked so that the count value reaches the target value, the latch circuit 36 for determining the target value is reset to output a "0" level, the clock select gate 32 outputs the decay clock $\phi_D$, and the up-down counter 34 starts down-counting. When the key is then released, the signal ES is outputted and the clock is switched to the release clock $\phi_{LE}$. When the envelope waveform assumes a "0" level, the channel reset signal CR is outputted so that the envelope circuit and the channel of the key code memory are reset to stop the operation.

Figure 12:
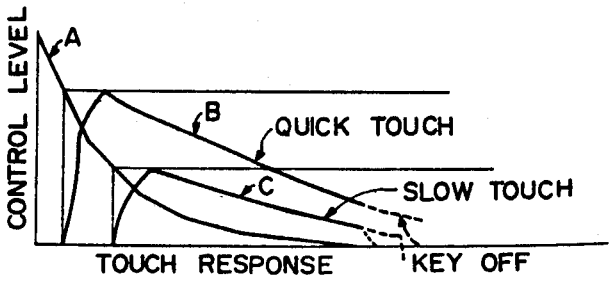
FIG. 12 is a characteristic curve showing the operation of a function generator.

FIG. 12 shows the envelope waveform and the touch level control waveform in accordance with the touch response, in case of using key switches having two contacts i.e., make and break, for example, the transfer type key switches. The touch level control waveform is shown by the curve A, which has the characteristic in which the control level on the axis of ordinate is substantially in inverse proportion to the touch response on the axis of abscissa, that is, the time from the opening of break to the closing of make. In the case of quick touch, the envelope waveform shown by the curve B is obtained, whereas in the case of slow touch, the envelope waveform shown by the curve C is obtained. In the illustrated embodiment, there is no sustainment appeared in a normal state, but the equal state thereto may be attained by applying a normal level.

Figure 14:
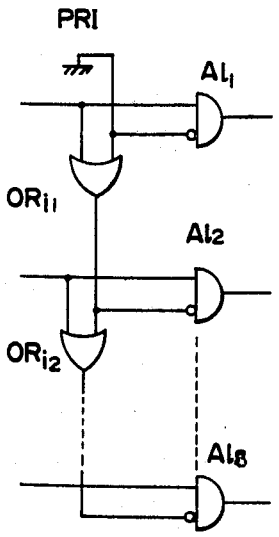
Figure 15:
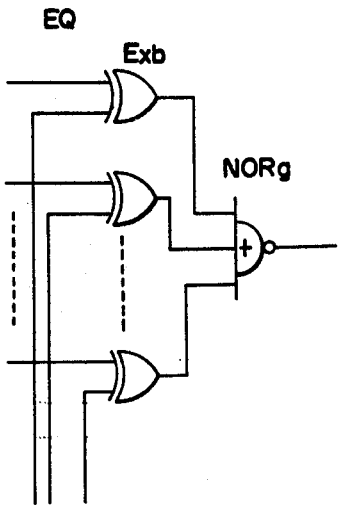
Figure 13:
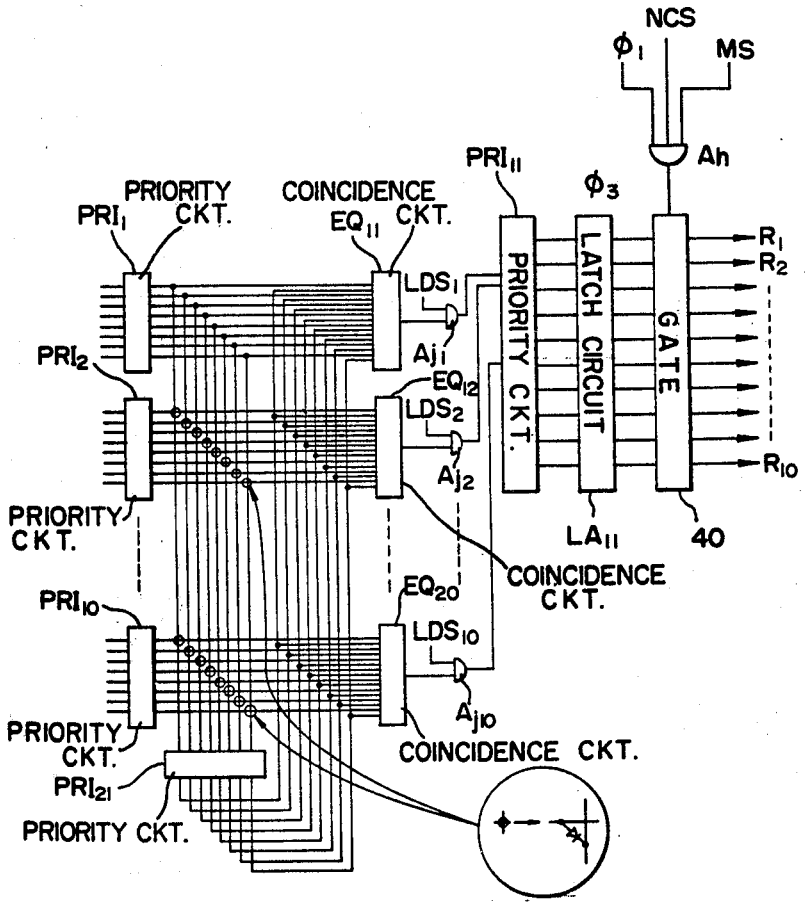

FIGS. 13, 14 and 15 are detailed explanatory views of the smallest level detector circuit 6 shown in FIG. 1. Envelope waveform signals of various channels are entered in priority circuits $PRI_1$–$PRI_{10}$, respectively, said signals being outputted in order of the highest bit first. This output is produced into WIRED ORed pass line and is inputted into a priority circuit $PRI_{21}$ giving a priority to the smallest bit, and the lowest level of the envelope waveform in various channels is detected. This output and outputs of the priority circuits $PRI_1$–$PRI_{10}$ are inputted into coincidence circuits $EQ_{11}$–

$EQ_{20}$ to detect the coincidence. Signals LDS produced from AND circuit $A_i$, OR circuit $OR_h$ in FIG. 11 and indicative of being decay release are inputted into AND circuits $A_{j1}$–$A_{j10}$ in FIG. 13 and are controlled so that the coincidence output is provided only when the envelope waveform is being decayed. Outputs of AND circuits $A_{j1}$–$A_{j20}$ are inputted into a priority circuit $PRI_{11}$, the output of the highest priority being outputted. This output is further latched by the latch circuit $LA_{11}$ with the clock $\phi_3$. Assume that all of channels produce sounds and no empty channel is present, the signal NCS is outputted from the channel assignment circuit 3. In order that when the key is further depressed, the most decayed channel is reset to produce a succeeding note, the signals MS and NCS and the clock $\phi_1$ are applied to GATE circuit 40 through the AND circuit $A_h$ to output a channel signal of the smallest level latched to the latch circuit $LA_{11}$, thus delivering a signal R for resetting said channel. Thereby, the key code memory circuit of said channel and the envelope waveform generator circuit 5 are reset to write-in the successive key code data into said channel.

FIG. 14 is an example of the priority circuit PRI in FIG. 13. That is, various inputs are inputted into AND circuit $A_{l1}$–$A_{l8}$ and OR circuits $OR_{il}$–$OR_{i7}$, and the AND circuit A is gated by the inverted input of the OR circuit $OR_i$. Accordingly, in this circuit, the AND circuit $A_{l1}$ is highest in priority, and the AND circuit $A_{l8}$ is lowest in priority so that only one having a higher priority among plural inputs is outputted.

FIG. 14 is an example of the coincidence circuit EQ shown in FIG. 13. Both inputs by which coincidence is detected are introduced into exclusive OR circuit $EX_b$, and outputs thereof are passed through NOR circuit $NOR_g$, whereby the coincidence of bits is outputted and when all of bits come into coincidence, "1" is outputted from the circuit $NOR_g$.

The envelope waveform generator apparatus in accordance with the present invention, which has been described in detail, comprises a key code generator means wherein a plurality of key switches having two contacts of make and break are used to divide blocks for scanning the blocks with a predetermined clock so that a time slot is provided only to a changed key switch to enhance its response, as explained in conjunction with FIG. 1 to FIG. 8A–J; a key assignor for read-in key code data into a plurality of channels in predetermined order of priority, as explained in conjunction with FIG. 9; and an envelope waveform generator circuit to which a touch response is added, as explained starting FIG. 10. Another proposal has been made with respect to the key code generator and the assignor just described above by the Applicant. The present invention is featurized by the structure of the envelope waveform generator circuit to which a touch response is added, which is the third element and adapted to the other two elements. That is, with the arrangement wherein a plurality of key switches of the transfer or other type having two contacts of make and break may be used to detect a difference in time between the on and off of the contacts, a waveform approximate to the envelope waveform is generated by a predetermined function generator according to said time, and a function generator having a step response characteristic relative to the target value or a function generator for forming a level set by detection of a touch level into a gradually access line may be used to readily set a level of the envelope waveform, not impairing a similarity of the waveform to respective levels. Further, quantized noises may be decreased by employment of a linear approximate waveform. Since the aforementioned function generator is simple in construction, there affords great advantages such that the control system may be simplified and the integration may readily be achieved. What is claimed is:

1. An envelope waveform generating apparatus comprising:

a key code generator which comprises means for dividing a plurality of key switches, each having two contacts, one for make and one for break, into blocks to be successively scanned with a predetermined clock, means for comparing switch information of every block being scanned with switch information of that block prior to that scanning to detect changes of the opening and closing of the break contact and the make contact, means responsive to the change detected to successively and continuously produce key code data corresponding to the key switches with a predetermined clock in accordance with predetermined priority, and means for producing a first control signal representative of the key code data resulting from the opening of the break contact and a second control signal representative of the key code data resulting from the closing of the make contact;

a key assignor which comprises means having a plurality of channels of the same number as the maximum number of tones simultaneously produced and for successively reading the key code data from the key code generator into empty ones of the plurality of channels in accordance with the predetermined priority, and means for comparing the key code data stored in each empty channel with the key code data provided from the key code generator to produce a third control signal upon coincidence of the both key code data being compared; and a function generator which comprises means for counting a predetermined input pulse from a preset initial value, means for calculating a difference value between the count value and a preset target value and means for controlling the pulse density of the input pulse with the difference value, the function generator having a first mode for calculating the highest level of an envelope to be generated and a second mode for generating an envelope waveform in accordance with the highest level obtained in the first mode.

2. An envelope waveform generating apparatus according to claim 1, which further comprises means for applying a touch response detection clock, the preset initial value and the target value being applied to the function generator in accordance with the first control signal, means operating to generate a predetermined function for the time from the opening of the break contact to the closing of the make contact and stopping the operation in accordance with the second control signal, and means for temporarily storing the generated function as the highest level of the envelope waveform to be generated, whereby the first mode is achieved.

3. An envelope waveform generating apparatus according to claim 1, which further comprises means for selecting a "0" level as the initial value and an attack clock with the highest level detected by the second control signal used as a target value to apply them to the function generator to start attack, means for selecting a sustain level of the next target value and a decay clock upon coincidence of the function value with the target value to apply them to the function generator start decay means for selecting a "0" level of the next target value, and a release clock by the third control signal to apply them to the function generator to start release, and means for resetting the channels when the function value reaches a "0" level, and wherein the output value of the function generator is used as an envelope waveform value.

4. An envelope waveform generating apparatus comprising:

a key code generator which comprises means for dividing a plurality of key switches, each having two contacts, one for make and one for break, into blocks to be successively scanned with a predetermined clock, means for comparing switch information for every block being scanned with switch information of that block prior to that scanning to detect changes of the opening and closing of the break contact and the make contact, means responsive to the change detected to successively and continuously produce key code data corresponding to the key switches with a predetermined clock in accordance with predetermined priority, and means for producing a first control signal representative of the key code data resulting from the opening of the break contact and a second control signal representative of the key code data resulting from the closing of the make contact;

a key assignor which comprises means having a plurality of channels of the same number as the maximum of tones simultaneously produced and for successively reading the key code data from the key gode generator into empty ones of the plurality of channels in accordance with predetermined priority, and means for comparing the key code data stored in each empty channel with the key code data provided from the key code generator to produce a third control signal upon coincidence of the both key code data being compared;

a function generator which comprises means for counting a predetermined input pulse from a preset initial value, means for calculating a difference value between the count value and a preset target value, and means for controlling the pulse density of the input pulse with the difference value, the function generator having a first mode for calculating the highest level of an envelope to be generated and a second mode for generating an envelope waveform in accordance with the highest level obtained in the first mode;

a lowest level detector which comprises means for detecting the most significant bit of an envelope data word for each channel in connection with the envelope waveform data under decay when a different key is further depressed while all of the channels produce sound, and means for detecting a channel presenting the least significant bit in the detecting means; and means for resetting the channel detected by the lowest level detector and assigning the key code to the detected channel.

5. An envelope waveform generating apparatus according to claim 4, which further comprises a minimal level detector comprising first priority means for detecting the most significant bit of the envelope data word for each channel, OR means for obtaining the logical sum of outputs of all channels of the first priority means for each bit, second priority means for giving the priority to the least significant bit of the output from the OR means, coincidence means for detecting coincidence of the outputs from the first and second priority means for each channel, and third priority means supplied with the output from the coincidence means to select one of the channels in accordance with a predetermined priority.

* * * * *